US006293191B1

(12) United States Patent
Rauh

(10) Patent No.: US 6,293,191 B1
(45) Date of Patent: Sep. 25, 2001

(54) DAMPENING ROLLER

(75) Inventor: Volker Gerold Rauh, Hettstadt (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/402,444

(22) Filed: Oct. 6, 1999

(30) Foreign Application Priority Data

Apr. 7, 1997 (DE) ..... 197 14 222

(51) Int. Cl.[7] ..... B41L 23/18
(52) U.S. Cl. ..... 101/148; 101/147
(58) Field of Search ..... 101/148, 147, 101/130, 348; 492/30, 38, 47, 56

(56) References Cited

U.S. PATENT DOCUMENTS

| | | | | |
|---|---|---|---|---|
| 2,126,768 | * | 8/1938 | Goedike | 101/147 |
| 3,296,964 | * | 1/1967 | Orr | 101/348 |
| 4,864,704 | * | 9/1989 | Hogan et al. | 29/119 |
| 4,967,663 | * | 11/1990 | Metcalf | 101/348 |
| 5,033,376 | | 7/1991 | Witczak | 101/148 |
| 5,191,835 | | 3/1993 | Blanchard | 101/148 |
| 5,222,434 | | 6/1993 | Smith et al. | 101/348 |
| 5,329,850 | | 7/1994 | Duarte . | |
| 5,649,481 | * | 7/1997 | Mueller et al. | 101/147 |
| 5,961,685 | * | 10/1999 | Streets et al. | 65/529 |
| 6,062,138 | * | 5/2000 | Fromson et al. | 101/217 |
| 6,126,583 | * | 5/2000 | Stefani | 491/31 |

FOREIGN PATENT DOCUMENTS

| | | | | |
|---|---|---|---|---|
| 2634555 | * | 11/1944 | (DE) | 101/147 |
| OS 1436542 | | 12/1964 | (DE) . | |
| AS 1761245 | | 4/1968 | (DE) . | |
| AS 2007554 | | 2/1970 | (DE) . | |
| 62913 | * | 11/1944 | (DK) | 101/148 |
| 25113181 | | 9/1981 | (FR) . | |

* cited by examiner

*Primary Examiner*—John S. Hilten
*Assistant Examiner*—Anthony H. Nguyen
(74) *Attorney, Agent, or Firm*—Jones, Tullar & Cooper, PC

(57) ABSTRACT

A dampening roller, which functions reliably and which can be driven by friction has a surface of a rubber-elastic material. Drive rings of equal diameter to that of the working surface of the dampening roller, as defined by the rubber-elastic material, are provided at either end of the dampening roller. These drive rings are also made of the same rubber-elastic surface material.

3 Claims, 1 Drawing Sheet

DAMPENING ROLLER

FIELD OF THE INVENTION

The present invention relates to a dampening roller for a dampening unit of a rotary offset printing press.

DESCRIPTION OF THE PRIOR ART

A dampening agent application roller having an elastic covering, and which can be driven by a plate cylinder by means of a frictional connection, is known from DE-OS 14 36 542. On its circumference, this dampening agent application roller has abutments at both ends. These abutments are arranged in a ring shape and are in rotatable contact with ring-shaped supports arranged on the circumference of the plate cylinder on both ends.

With this drive, it is disadvantageous that both the rings of the abutment and the elastic covering of the driven dampening agent application roller are made of different materials. It is furthermore disadvantageous that, because of the clamped-on printing plates, the ring-shaped supports located at the ends of the plate cylinder have a larger diameter in comparison to the plate cylinder and are also made of a different material.

U.S. Pat. No. 5,191,835 describes a dampening unit for a rotary printing press with the dampening unit having four dampening rollers. A dampening agent application roller, which works directly together with the printing cylinder, is frictionally driven, while the dampening rollers, which are connected upstream of this dampening agent application roller, are driven in an interlocking manner by means of gear wheels.

DE-AS 17 61 245 and U.S. Pat. No. 5,033,376, respectively each disclose a damping roller, whose end is provided with a drive ring. The drive ring and the barrel of the dampening roller have the same diameter.

U.S. Pat. No. 5,222,434, describes an ink and dampening agent roller which has spindle-like grooves for transporting ink, or respectively dampening agent.

SUMMARY OF THE INVENTION

The object of the present invention is based on providing a dampening roller which can be frictionally driven by a roller located at any arbitrary position in the dampening unit.

In accordance with the present invention, this object is attained by, providing a dampening roller in which at least one end of the roller is provided with at least one drive ring. This drive ring, and a barrel portion of the dampening roller have the same diameter. The dampening roller has a rubber-elastic coating and the drive ring is defined by an annular groove which is cut into the coating.

The advantages which can be achieved by the present invention particularly lie in that the dampening roller has a uniform elastic covering over its entire surface, and in which covering drive rings can be formed in a cost-effective manner at both ends by means of a "recess". Therefore, no additional abutments are needed. The dampening roller can be placed with its drive rings against any roller of the dampening unit provided with a hard surface, and can be driven by it, without additional supports being required for this. The dampening roller of the present invention can be particularly advantageously placed against a reciprocating, driven dampening distribution roller, i.e. a distribution roller which is moving back and forth in the axial direction.

It is and advantageous that, with the same diameters of barrels and drive rings, the same roll-off proportions, i.e. the same circumferential speeds, can be achieved.

In accordance with an advantageous variation of the present invention, the drive rings have a profile, which carries dampening agent away. This is used, in particular, if a reciprocating chromium roller is arranged upstream of the dampening agent application rollers in the dampening path. In this way, along with satisfactory friction of the dampening agent application roller, an even application of dampening agent over the width of the dampening agent application roller which conducts dampening agent is provided by means of the drive rings.

BRIEF DESCRIPTION OF THE DRAWINGS

A preferred embodiment of the present invention is represented in the drawings and will be described in greater detail in what follows.

Shown are in:

FIG. 2, a detail "Z" from FIG. 1, with the enlarged representation of a drive ring arranged on the dampening roller and in;

DESCRIPTION OF THE PREFERRED EMBODIMENTS

Figure 1:
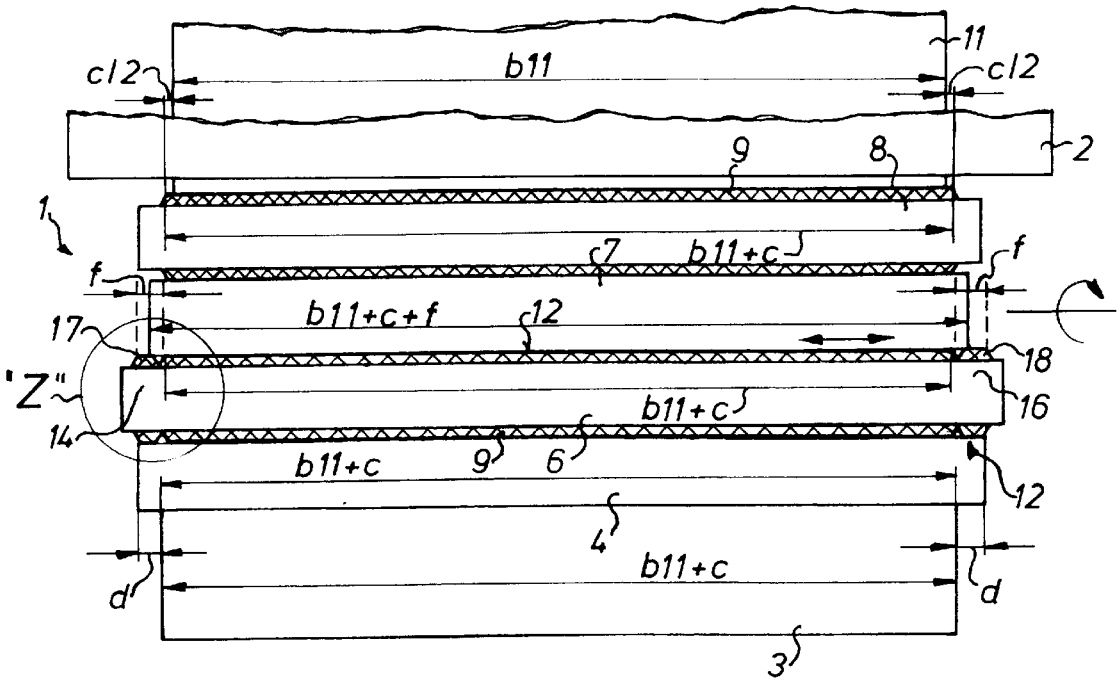
FIG. 1, a longitudinal section through a schematic representation of a dampening unit in accordance with the present invention.

A dampening unit 1 for a plate cylinder 2 of a rotary offset printing press consists, for example, of a spray bar 3, which acts against a chromium roller 4, a dampening agent transfer roller 6 in accordance with the present invention, a reciprocating dampening agent distribution roller 7 and a dampening agent application roller 8 acting on the plate cylinder 6. This dampening unit 1 is shown in FIG. 1

The spray bar 3 can be designed as a known spray nozzle unit. The dampening agent distribution roller 7 is driven via a suitable drive means, for example a train of gear wheels, not specifically depicted by the plate cylinder 2 and can be made of chromium or a ceramic material such as for example aluminum oxide or chromium oxide.

Each dampening roller 6, 8 has a rubber-elastic coating 9, for example, a covering of rubber on the roller body. With respect to a maximum width b11 of a paper web 11, each dampening roller 6, 8 has an effective barrel length or working width of b11+c, where c for example 10 mm. On the dampening agent transfer roller 6, the working width b11+c is bordered on both sides by annular grooves 13, which are located at the circumference 12 and of the dampening agent transfer roller 6, which have been cut into the coating 9. On the other or outboard sides of the annular grooves 13, the ends 14, 16 of the dampening agent transfer roller 6 are provided drive rings 17, 18 formed by coating 9 of the same material, for example, rubber. The drive rings 17, 18 each have a width d of, for example, 30 mm.

The reciprocating dampening agent distribution roller 7 has an effective working width of b11+c+f and has an axial stroke length f, for example of ±15 mm. The chromium roller 4 is of a length which projects past the working width b11+c respectively by the amount d on both sides, all as may be seen in FIG. 1.

The above mentioned cylinders and rollers 2, 4, 6, 7, 8 are seated, fixed in place in lateral frames, of a notary offset printing machine the same as the spray bar 3. The lateral or side frames of the printing machine are not specifically depicted.

The functioning of the dampening roller of the present invention is as follows: the spray bar 3 transfers the dampening agent to the chromium roller 4 over the working width b11+c. In this case, an area d at both ends of the chromium roller 4, which area extends past the working width b11+c, remains dry, or is only provided with little moisture, so that the chromium roller 4 is driven by means of the friction rings 17, 18 of the dampening agent transfer roller 6. The dampening agent transfer roller 6 receives dampening agent from the chromium roller 4 and passes it on to the reciprocating dampening agent distribution roller 7. The drive of the dampening agent transfer roller 6 is provided by frictional connection with the two areas f on the dampening agent distribution roller 7, which act on the drive rings 17, 18 of the dampening agent transfer roller 6.

Because of the back and forth motion of the dampening agent distribution roller 7 by the amount f—shown in dashed lines in FIG. 1—, at least one of the two drive rings 17, 18 of the dampening agent transfer roller 6 is always in a frictional connection with one of the two ends of the dampening agent distribution roller 7. An intentional re-moistening of the drive rings 17, 18 with dampening agent takes place in the course of this axial back and forth motion of the dampening agent distribution roller 7 in order to cool and lubricate the drive rings 17, 18.

The dampening agent distribution roller 7 is driven by means of a gear wheel train of the plate cylinder 2 and transfers the spread dampening agent to the dampening agent application roller 8, which moistens the printing plates of the plate cylinder 2. The dampening agent application roller 8 is driven by the reciprocating dampening distribution roller 7, as well as by the plate cylinder 2, by means of a frictional connection. Therefore, no drive rings 17, 18 are required on the dampening agent application roller 8.

In accordance with a second preferred embodiment which is, not specifically represented in the drawings, the chromium roller 4 can be driven by the plate cylinder 2, and can be moved axially back and forth by means of a gear wheel train, instead of by the reciprocating and driven dampening agent distribution roller 7. In this way, at least two further rollers 6 and 7 are frictionally driven by the driven chromium roller 4, wherein the drive of the second dampening agent application roller 8 is partially provided by the plate cylinder 2. In this case, both dampening rollers 6, 8 are usefully provided with drive rings 17, 18 at both ends for an improved frictional connection.

The drive rings 17, 18 can be used for the frictional drive of the dampening roller having the drive rings 17, 18, as well as for the frictional drive of a directly cooperating roller. It is also possible to provide only one end 14, 16 of the dampening agent transfer roller 6 with a drive ring. There is the further possibility of providing the chromium roller 4, for example, with drive rings 17, 18. These can have a rubber-elastic coating 9, for example.

Figure 3:
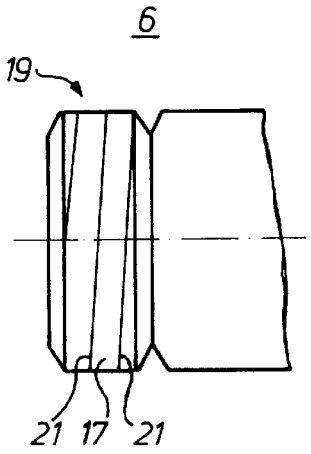
FIG. 3, a profiled support ring.
Figure 2:
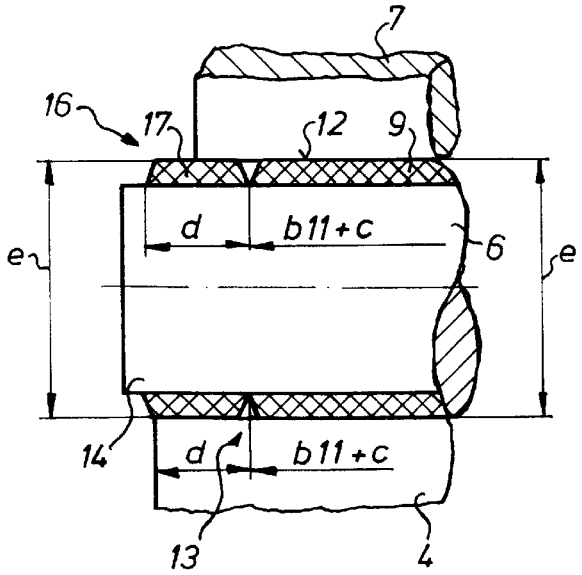

Since more dampening agent than shown in the first preferred embodiment is transferred on the drive rings 17, 18 by the axial stroke of the chromium roller 4 arranged downstream of the spray bar 3, it is useful to provide the drive rings 17, 18 with a surface profile, which carries the dampening agent away. Such a surface profile, which carries the dampening agent away, can, for example, consist of grooves 21, as seen in FIG. 3. The grooves 21 helically encircle the surface of the drive rings 17, 18 and convey the dampening agent away from the dampening agent roller 6, 8 in the direction toward the ends of the roller 6,8.

While preferred embodiments of a dampening roller in accordance with the present invention have been set forth fully and completely hereinabove, it will be apparent to one of skill in the art that a number of changes in, for example, the specific dampening agent being applied, the drive for the plate cylinder, and the like could be made without departing from the true spirit and scope of the present invention which is accordingly to be limited only by the following claims.

What is claimed is:

1. A dampening roller comprising:

a dampening roller body;

a rubber-elastic coating on said dampening roller body;

a barrel portion formed by said rubber-elastic coating, said barrel portion having a first diameter;

a first drive ring portion formed by said rubber-elastic coating at an end of said barrel portion, said first drive ring portion having said first diameter; and an annular groove cut in said rubber elastic coating portion intermediate said barrel portion and said first drive ring portions said annular groove defining said first drive ring portion and said barrel portion of said rubber-elastic coating.

2. The dampening roller of claim 1 further including a second drive ring portion arranged on a second end of said rubber-elastic coating.

3. The dampening roller of claim 1 further wherein said first drive ring portion has a surface profile.

* * * * *